US011156043B2

(12) United States Patent
Ross et al.

(10) Patent No.: US 11,156,043 B2
(45) Date of Patent: Oct. 26, 2021

(54) METHOD OF CONTROLLING A WELL

(71) Applicant: METROL TECHNOLOGY LIMITED, Aberdeen (GB)

(72) Inventors: Shaun Compton Ross, Aberdeen (GB); Leslie David Jarvis, Stonehaven (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 0 days.

(21) Appl. No.: 16/647,572

(22) PCT Filed: Sep. 18, 2018

(86) PCT No.: PCT/GB2018/052658

§ 371 (c)(1),
(2) Date: Mar. 16, 2020

(87) PCT Pub. No.: WO2019/063972

PCT Pub. Date: Apr. 4, 2019

(65) Prior Publication Data

US 2020/0277830 A1 Sep. 3, 2020

(30) Foreign Application Priority Data

Sep. 26, 2017 (GB) ..... 1715584

(51) Int. Cl.
*E21B 21/08* (2006.01)
*E21B 47/13* (2012.01)
(Continued)

(52) U.S. Cl.
CPC ..... *E21B 21/08* (2013.01); *E21B 21/10* (2013.01); *E21B 34/063* (2013.01); *E21B 47/06* (2013.01); *E21B 47/13* (2020.05); *E21B 47/18* (2013.01)

(58) Field of Classification Search
CPC ..... E21B 21/08; E21B 47/13; E21B 21/10; E21B 34/063; E21B 47/06; E21B 47/18;
(Continued)

(56) References Cited

U.S. PATENT DOCUMENTS 4,791,373 A 12/1988 Kuckes
5,230,387 A * 7/1993 Waters ..... E21B 7/068 175/45

(Continued)

FOREIGN PATENT DOCUMENTS

GB 1585479 3/1981
WO 2002084067 10/2002

(Continued)

OTHER PUBLICATIONS

Written Opinion of the International Preliminary Examining Authority for PCT/GB2018/052658, dated Aug. 5, 2019.

(Continued)

*Primary Examiner* — Brad Harcourt
(74) *Attorney, Agent, or Firm* — Womble Bond Dickinson (US) LLP

(57) ABSTRACT

A method of controlling a well in a geological structure, the well comprising: a first casing string (12*a*), and a second casing string (12*b*) at least partially inside the first casing string thus defining a first inter-casing annulus therebetween. A primary fluid flow control device (16*a*), such as a wirelessly controllable valve, is provided in the second casing string (12*b*) to provide fluid communication between the first inter-casing annulus (14*a*) and a bore (14*b*) of the second casing string (12*b*). In the event of well "blow-out", a relief well (40) may be drilled and a fluid communication path formed between the relief well and the first casing string of the well rather than extend to lower and/or narrower sections of casing. A kill fluid can then be introduced via the (Continued)

relief well (40) and the primary fluid flow control device (16*a*) used to direct fluid to the second casing bore (14*b*). Further casing strings (12*c*) may be part of the well, and include corresponding flow control devices (16*b*), allowing the kill fluid to cascade down the well to control it. Accordingly, the time taken to drill a relief well to a shallower depth than is conventional can reduce the time and cost to control the well and can mitigate environmental impact of hydrocarbon loss caused by the blow-out.

25 Claims, 1 Drawing Sheet

(51) Int. Cl.

| | |
|---|---|
| ***E21B 21/10*** | (2006.01) |
| ***E21B 34/06*** | (2006.01) |
| ***E21B 47/06*** | (2012.01) |
| ***E21B 47/18*** | (2012.01) |

(58) Field of Classification Search
CPC ..... E21B 43/17; E21B 29/06; E21B 29/08; E21B 34/06
See application file for complete search history.

(56) References Cited

U.S. PATENT DOCUMENTS

| | | | | |
|---|---|---|---|---|
| 2005/0189107 | A1* | 9/2005 | McVay | E21B 41/00 166/242.1 |
| 2007/0278008 | A1 | 12/2007 | Kuckes et al. | |
| 2011/0114333 | A1* | 5/2011 | Fenton | E21B 34/08 166/373 |
| 2011/0290501 | A1* | 12/2011 | Duncan | E21B 33/064 166/363 |
| 2015/0240592 | A1 | 8/2015 | Ross et al. | |
| 2016/0053542 | A1 | 2/2016 | Stafford | |
| 2017/0248006 | A1* | 8/2017 | Hess | E21B 43/17 |

FOREIGN PATENT DOCUMENTS

| | | |
|---|---|---|
| WO | 2004079240 | 9/2004 |
| WO | 2011067372 | 6/2011 |
| WO | 2012010897 | 1/2012 |
| WO | 2016057014 | 4/2016 |
| WO | 2017027978 | 2/2017 |
| WO | 2019063973 | 4/2019 |
| WO | 2019063974 | 4/2019 |

OTHER PUBLICATIONS

Combined Search and Examination Report for GB Application No. 1715584.7, dated Feb. 21, 2018.
International Preliminary Report on Patentability for PCT/GB2018/052658, dated Nov. 11, 2019.
GCC Patent Office Examination Report for Corresponding Gulf Cooperation Application No. 2018/36077, dated Nov. 29, 2020.
International Search Report for PCT/GB2018/052658, dated Dec. 10, 2018.
Mingge He et al, "A New Completion Hardware: Intelligent Casing Sleeve Based on Electromagnetic Wireless Communication", Society of Petroleum Engineers, SPE-181794-MS, 2016.
Mikolaj Ralowski, "Design of a hypothetical relief well for a shallow reservoir, possible challenges.", University of Stavanger, May 30, 2016, pp. 15-32.
Canada Intellectual Property Office, Office Action for Canadian Application 3,114,546, dated Apr. 29, 2021.

* cited by examiner

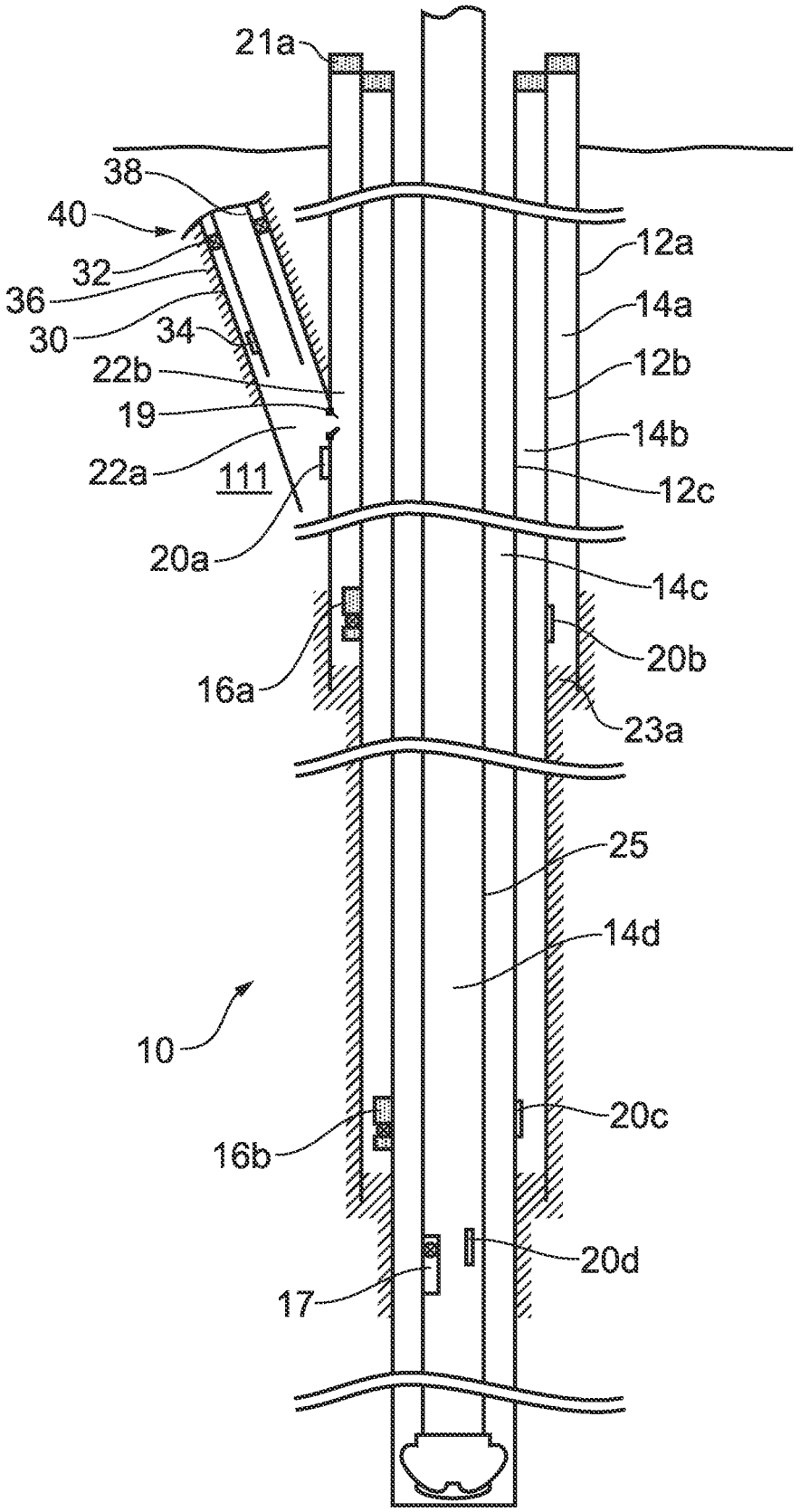
21a
38
40
32
36
30
34
22b
19
22a
111
20a
12a
14a
12b
14b
12c
14c
20b
16a
23a
25
14d
10
20c
16b
20d
17

METHOD OF CONTROLLING A WELL

CROSS REFERENCE TO RELATED APPLICATIONS

This application is a 35 U.S.C. 371 National Stage of International Application No. PCT/GB2018/052658, titled "METHOD OF CONTROLLING A WELL", filed Sep. 18, 2018, which claims priority to GB Application No. 1715584.7, titled "METHOD OF CONTROLLING A WELL", filed Sep. 26, 2017, all of which are incorporated by reference herein in their entirety.

This invention relates to a method of controlling a well in a geological structure.

The drilling of boreholes, particularly for hydrocarbon wells, is a complex and expensive exercise. Reservoir conditions and characteristics need to be considered and evaluated constantly during all phases of the well's life so that it is designed and positioned to recover hydrocarbons as safely and efficiently as possible.

A borehole having a first diameter is initially drilled out to a certain depth and a casing string run into the borehole. A lower portion of the resulting annulus between the casing string and borehole is then normally cemented to secure and seal the casing string. The borehole is normally extended to further depths by continued drilling below the cased borehole at a lesser diameter compared to the first diameter, and the deeper boreholes then cased and cemented. The result is a borehole having a number of generally nested tubular casing strings which progressively reduce in diameter towards the lower end of the overall borehole.

As technology has advanced, and the understanding of borehole geometry and hydrocarbon geology has improved, companies have been able to extend the potential areas for finding and producing from downhole reservoirs. For example, in recent years hydrocarbons have been recovered from offshore subsea wells in very deep water, of the order of over 1 km. This poses many technical problems in drilling, securing, extracting, suspending and abandoning wells at such depths.

In a subsea environment a Blow-Out-Preventer (BOP) is connected to the drilling rig by way of a marine riser. Drill pipe can be lowered down through one or more of the marine riser, through the BOP, into a wellhead, and then down into the well to drill deeper into the ground. As drilling fluid or mud is pumped through the drill pipe and out through the drill bit, it circulates all the way around up through the marine riser back to the surface facility.

As the drill bit continues to make its way towards the hydrocarbons or 'pay zone', the drilling company closely monitors the amount of drilling fluid in storage tanks as well as the pressure of the formation(s) to ensure that the well is not experiencing a blow-out or 'kick'.

Drilling fluid can be much heavier than sea water, in some cases more than twice as heavy. This is helpful when drilling a well because its weight creates enough head pressure to keep any pressure in the hydrocarbon formation(s) from escaping back up through the well. The heavier the drilling fluid used when drilling a well, the less likely it is that formation pressure escapes back up into the well and up the marine riser. On the other hand, if the drilling fluid used whilst drilling is too heavy, there is a risk of losing fluid to the well and/or losing well control. When this happens the drilling fluid begins leaking out into the underground formation(s). This is an issue because without being able to circulate the drilling fluid back to the surface, it will not be possible to drill any deeper. Moreover, when drilling fluid is lost there will be less drilling fluid in the fluid column above the drill bit, thus reducing its hydrostatic pressure, and possibly resulting in a 'kick' or blow-out from the well. As the well is drilled deeper and deeper, the drilling fluid weight operating window gets smaller and smaller and the potential for a kick/blow-out/loss of well control situation occurring increases.

In the event of a failure in the integrity of a subsea well, wellhead control systems are known to shut the well off to prevent a dangerous blow-out, or significant hydrocarbon loss from the well. The BOP can be activated from a control room to shut the well. Should this fail, a remotely operated vehicle (ROV) can directly activate the BOP at the seabed to shut the well.

In a completed well, rather than a BOP, a Christmas Tree is provided at the top of the well and a subsurface safety valve (SSSV) is normally added downhole. The SSSV is normally near the top of the well. The SSSV is normally activated to close and shut the well if it loses communication with the controlling platform, rig or vessel. A wellhead may comprise a BOP or a Christmas tree.

Despite these known safety controls, accidents still occur and a blow-out from a well can cause an explosion resulting in loss of life, loss of the rig and a significant and sustained escape of hydrocarbons into the surrounding area, threatening workers, wildlife and marine and/or land based industries. Blow-outs can also occur downhole in the formations and possibly cause a rupture in the earth's surface away from the well, which are particularly difficult to deal with.

The well in the geological structure may be any offshore or land based well.

In the event of a major failure in the integrity of a well, a relief well has traditionally been drilled to intersect and control the well but drilling takes time and the longer it takes, the more hydrocarbons and/or drilling/well fluids are typically released into the environment.

An object of the present invention is to mitigate problems with the prior art, and provide an alternative method to control wells.

According to an aspect of the present invention, there is provided a method of controlling a well in a geological structure, the well comprising:

- a first casing string and a second casing string, the second casing string at least partially inside the first casing string;
- the first casing string and the second casing string defining a first inter-casing annulus therebetween, the second casing string defining a second casing bore therewithin; and
- a primary fluid flow control device in the second casing string to provide fluid communication between the first inter-casing annulus and the second casing bore; the method comprising the steps of:
- introducing a fluid into the first inter-casing annulus; and
- opening the primary fluid flow control device and directing the fluid between the first inter-casing annulus and the second casing bore.

The step of introducing a fluid into the first inter-casing annulus typically includes:

- drilling a borehole through at least a portion of the geological structure to reach the well, thus creating a relief well;
- creating a fluid communication path through the first casing string to provide fluid communication between the relief well and the first inter-casing annulus of the well; and introducing a fluid into the relief well and then into the first inter-casing annulus.

There are a number of reasons a well in a geological structure may be out of control or it may be difficult to proceed.

If there is a well kick or blow-out, it may be possible to circulate or pump fluids into the well conventionally from the top of the well to control the well. The method of controlling the well provides an alternative path to pump fluid into the well and/or circulate fluids in the well and thus control the well. If there is a blockage in the well preventing conventional circulation and/or pumping of fluids, the method of controlling the well provides an alternative path to pump fluid into the well and/or circulate fluids in the well and thus control the well.

It is however not uncommon for the blow-out or blockage to mean that it is no longer possible to circulate fluid into the second casing bore or a well internal tubular, a production tubing, a completion tubing, and/or a drill pipe in the casing bore. It may be an advantage of the present invention that the method can be used to direct fluid into the first inter-casing annulus, and then through the primary fluid flow control device, into the second casing bore to provide the necessary integrity to bring the well back under control.

The method of controlling a well is typically a method of fluid management. Fluid management includes controlling fluid type, density, pressures and/or weights. Management may be by pumping fluid into the well, for example for full or partial circulating, bull heading and/or displacing fluid and/or controlling pressure.

The method of the present invention may be particularly useful for controlling pressure in the well which cannot be controlled using other, typically more direct, operations. For example, if a drill string becomes stuck in a formation, for example because of 'bridging', it can traditionally be difficult to rectify because of well pressure below a bridge.

The method of the present invention may be used to mitigate or solve such a problem by killing, or at least containing in part, fluid pressure in the well by introducing the fluid into the first inter-casing annulus and opening the primary fluid flow control device to enable the introduction and/or circulation of fluid into the second casing bore. There is thereby the option to at least contain in part the pressure of fluid in the well. Normally a fluid flow control device below the bridge is used.

The fluid in the second casing bore, and other casing bore(s) if used, may be sufficient to gain more control over the well, by killing or at least partially killing it.

The method of fluid management may be for changing the fluid in the first inter-casing annulus and/or the second casing bore to manage well integrity. Managing well integrity may include introducing fluids to mitigate leaks to or from the first inter-casing annulus and/or the second casing bore. Managing well integrity may include introducing fluids into first inter-casing annulus and/or the second casing bore to control corrosion. Managing well integrity may include introducing cement into first inter-casing annulus and/or the second casing bore. An advantage of managing well integrity may be to reduce the need for early well work over.

The method may include the step of drilling a borehole through at least a portion of the geological structure to reach the well, thus creating a relief well. The method may include the step of introducing the fluid into the relief well. The method may include the step of directing the fluid from the relief well into the first inter-casing annulus. Optionally the relief well is cased. A relief well may be drilled to intersect the well at an appropriate position and may be below a blockage.

It may be an advantage of the present invention that the relief well only needs to be drilled and/or penetrate and/or enable fluid communication with and/or to contact the first casing string. The relief well typically only penetrates the first casing string. The relief well typically does not penetrate the second casing string.

The first casing string is typically an outermost casing string at a depth where the relief well reaches the well. The casing string(s) may be referred to and/or comprise a liner (s).

The well may be a subsea well.

It may be a further advantage of the present invention that by enabling fluid communication with the first casing string this provides access to the rest of the well of the present invention. This can be relatively near the surface. It may be an advantage of the present invention that the fluid pressure throughout the relief well and the first inter-casing annulus may be comparable to that of a traditional relief well drilled to the bottom of the well, but this method saves the time and cost spent drilling a much deeper relief well.

The fluid pressure in the well and/or relief well is typically related to the hydrostatic head of the fluid.

Traditionally, the relief well contacts the blow-out well many thousands or tens of thousands of feet deep and the relief well can take several days, weeks or even months to drill and reach this depth. Meanwhile the hydrocarbons can continue to flow from the existing well and pollute and damage the surrounding environment and wildlife. Two relief wells may be drilled simultaneously in case one should fail. This is costly.

The relief well typically contacts the first casing string relatively near the surface, that is typically at a depth of less than 2000 meters, normally at a depth of less than 1000 meters and may be at a depth of less than 500 meters. On deeper wells the relief well may be deeper. On shallower wells the relief well may be nearer the surface. The well normally further comprises a fluid port in the first inter-casing annulus. The fluid port may be a well head port which may be at or adjacent a well head. The well head fluid port may be at surface for land wells or at the seabed for subsea wells. There may be more than one well head fluid port. The relief well and/or an interface between the relief well and the well and/or casing may be referred to as a fluid port. The method may include the step of passing the fluid through the well head port and/or relief well.

There may be a fluid port in the side and/or wall of the first casing string. There may be a fluid port in the bottom of the first casing string. There may be two or more fluid ports in the first casing string.

The method may include the step of passing the fluid through a fluid port and/or relief well.

The method may include the step of introducing the fluid into the first inter-casing annulus through the fluid port.

The fluid may be introduced into the first inter-casing annulus at a wellhead. This is particularly suitable for onshore and/or offshore platform wells where access to the first inter-casing annulus is more common. The well in the geological structure may be land based rather than subsea.

Conventionally in a subsea completed well, fluid porting is not provided at the surface of the well to the outer annuli. According to the present invention, there may be a subsea well with fluid porting into the first inter-casing annulus. Conventionally, fluid ports are not provided into the annuli due to the complexities involved in a subsea completed well.

Embodiments of the present invention provide an advantage that access to multiple annuli can be provided by a single fluid port at surface into an outer annuli.

Alternatively, fluid may be introduced into the first inter casing annulus via the primary fluid flow control device and controlled and/or produced via the fluid port.

The first inter-casing annulus is typically the so called a annulus although it may be another annulus, especially an outer inter-casing annulus, depending on the circumstances of the blow-out and the well construction and/or infrastructure. The first inter-casing annulus may be referred to as the first casing bore.

The method of controlling the well may be a method of killing the well. Killing the well normally involves stopping flow of produced fluids up the well to surface. Killing the well may include balancing and/or reducing fluid pressure in the well to regain control of the well, and is not limited to stopping it from flowing or its ability to flow, though it may do so. The fluid may be, or may be referred to as, a kill fluid. The fluid is normally a drilling mud-type fluid but other fluids such as brine and cement may be used.

Kill fluid is any fluid, sometimes referred to as kill weight fluid, which is used to provide hydrostatic head typically sufficient to overcome reservoir pressure.

The first inter-casing annulus is typically an area between the first casing string and the second casing string that is not cemented.

The primary fluid flow control device in the second casing string may be in a wall of the second casing string. The primary fluid flow control device in the second casing string may be in a casing sub of the second casing string.

The well may be a pre-existing well. The geological structure may be at least one geological structure of a plurality of geological structures. The well may be any kind of borehole and is not limited to a producing well, thus the well may be a borehole intended for injection, observational purposes, or may be an economically unfeasible well. The well in the geological structure may be one or more of a water well, a well used for carbon dioxide sequestration, and a gas storage well.

A relief well is typically a borehole that does not produce fluids.

Whilst typically associated with blow-out wells, the method of the present invention may be used for other purposes to carry out remedial action on a well or casing.

The second casing string typically has a diameter less than a diameter of the first casing string.

Before the primary fluid flow control device is opened, fluid communication between the first inter-casing annulus and the second casing bore is typically one or more of resisted, mitigated and prevented.

The primary fluid flow control device may comprise one or more of a valve, casing valve, rupture mechanism, perforating device, pyrotechnic device, explosive device and puncture device.

The step of introducing the fluid may comprise pumping the fluid.

The method may further include the step of:

measuring at least one of pressure and density of the fluid in at least one of the first inter-casing annulus and second casing bore.

The method may further include the step of:

measuring at least one of pressure and density of the fluid in at least one of the first inter-casing annulus and second casing bore before opening the primary fluid flow control device and directing the fluid from the first inter-casing annulus into the second casing bore.

The step of measuring at least one of the pressure and density typically includes transmitting pressure and/or density data to surface using wireless communication through the well. The wireless communication is normally by means of at least one of an acoustic signal, electromagnetic signal, pressure pulse and inductively coupled tubulars. The communication to surface through the well may only be partially wireless, and/or only partially through the well.

It may be an advantage of the present invention that by measuring at least one of pressure and density of the fluid in at least one of the first inter-casing annulus and second casing bore before opening the primary fluid flow control device, fluid can be safely moved around in the well with the confidence that opening the primary flow control device will result in the safe and/or controlled movement of the fluid from the first inter-casing annulus into the second casing bore.

The primary flow control device is typically opened when the pressure of the fluid in the first inter-casing annulus is greater than the pressure of fluid in the second casing bore.

The well may further comprise:

a third casing string defining a third casing bore therewithin, the second casing string and the third casing string defining a second inter-casing annulus therebetween; and a secondary fluid flow control device in the third casing string to provide fluid communication between the second inter-casing annulus and the third casing bore; the method further including the step of:

opening the secondary fluid flow control device and directing the fluid between the second inter-casing annulus and the third casing bore.

The third casing string may be a liner.

The primary and secondary fluid flow control devices typically provide apertures for the flow of fluid between first inter-casing annulus and second inter-casing annulus and/or the second inter-casing annulus and the third casing bore. The second inter-casing annulus when there is a first, a second and a third casing string is typically the second casing bore when there is a first and a second casing string. The second inter-casing annulus and the second casing bore are typically the same part of the well.

The method may further include the steps of:

measuring at least one of pressure and density of the fluid in at least one of the second inter-casing annulus and third casing bore before opening the secondary fluid flow control device and directing the fluid from the second inter-casing annulus into the third casing bore.

The step of measuring at least one of the pressure and density of the fluid typically includes transmitting pressure and/or density data to surface using wireless communication through the well. The wireless communication is normally by means of at least one of an acoustic signal, electromagnetic signal, pressure pulse and inductively coupled tubulars. The communication to surface through the well may only be partially wireless, and/or only partially through the well.

It may be an advantage of the present invention that by measuring at least one of pressure and density of the fluid in at least one of the second inter-casing annulus and third casing bore before opening the secondary fluid flow control device, fluid can be safely moved around in the well with the confidence that opening the secondary flow control device will result in the movement of the fluid from the second inter-casing annulus into the third casing bore.

When the method includes both the steps of measuring at least one of pressure and density of the fluid in at least one of the first inter-casing annulus and second casing bore, also referred to as the second inter-casing annulus, and the step of measuring at least one of pressure and density of the fluid in at least one of the second inter-casing annulus and third casing bore, it may be an advantage of the present invention that fluid can be safely moved around in the well with the confidence that opening the primary flow control device and secondary fluid flow control device will result in the movement of the fluid from the first inter-casing annulus into the second inter-casing annulus, and then into the third casing bore.

Before the secondary fluid flow control device is opened, fluid communication between the second inter-casing annulus and the third casing bore is one or more of resisted, mitigated and prevented.

The third casing bore may contain one or more of a well internal tubular, a production tubing, a completion tubing, a drill pipe, a fluid flow control device, one or more sensors, one or more batteries and one or more transmitters, receivers or transceivers. The well tubular may be any one or more of a casing, liner, production tubing, completion tubing, drill pipe, injection tubular, observation tubular, abandonment tubular, and subs, cross overs, carriers, pup joints and clamps for the aforementioned.

The well may further comprise a plurality of casing strings and a plurality of inter-casing annuli. There is typically a plurality of fluid flow control devices to provide fluid communication between the annuli. The casing strings are typically nested with one casing string being at least partially inside another casing string.

The fluid flow control device(s) in one casing string can be the fluid port(s) in a different inter-casing annulus. When the fluid flow control device(s) in one casing string is the fluid port(s) in a different inter-casing annulus, the fluid port may be spaced away from the wellhead.

The fluid flow control device(s) can typically be opened and closed. Opening and/or closing the fluid flow control device may be referred to as activating the fluid flow control device. When the primary fluid flow control device is closed, fluid flow between the first inter-casing annulus and the second casing bore is restricted and may be stopped.

The well may further comprise:

one or more sensors at one or more of a face of the geological structure, in the well, in the first inter-casing annulus, in the second casing bore, in a/the third casing bore, in and/or on a well tubular;

the method further including the step of:

using data from the one or more sensors to one or more of optimise, analyse, assess, establish and manipulate properties of the fluid that is introduced into one or more of the first inter-casing annulus, the second casing bore, a/the third casing bore, the well tubular.

The data from the one or more sensors is normally transmitted by one or more of an acoustic signal, electromagnetic signal, pressure pulse and inductively coupled tubulars.

The step of using data from the one or more sensors to one or more of optimise, analyse, assess, establish and manipulate properties of the fluid typically relies on data collected using the one or more sensors, that is then used and/or processed to suggest changes to the properties of fluid.

The method may further include the step of collecting data from the one or more sensors after the well has been killed to continue to monitor the well constantly or periodically for short or long term periods of days, weeks, months or years.

The one or more sensors are typically attached to one or more of the first, second and third casing string, a well internal tubular, a production tubing, a completion tubing, and a drill pipe.

One or more of the primary fluid flow control device, secondary fluid flow control device, one or more sensors, one or more batteries and one or more transmitters, receivers or transceivers may be connected on or between a sub, carrier, pup joint, clamp and/or cross-over.

When the one or more sensors are attached they may be connected to one or more of the first, second and third casing string/a sub, a well internal tubular, a production tubing, a completion tubing, a drill pipe and/or in a wall of one or more of the first, second and third casing string/a sub, a well internal tubular, a production tubing, a completion tubing, and a drill pipe. There may be many suitable forms of connection.

The one or more sensors may sense a variety of parameters including but not limited to one or more of pressure, temperature, load, density and stress. Other optional sensors may sense, but are not necessarily limited to, the one or more of acceleration, vibration, torque, movement, motion, cement integrity, direction and/or inclination, various tubular/casing angles, corrosion and/or erosion, radiation, noise, magnetism, seismic movements, strains on tubular/casings including twisting, shearing, compression, expansion, buckling and any form of deformation, chemical and/or radioactive tracer detection, fluid identification such as hydrate, wax and/or sand production, and fluid properties such as, but not limited to, flow, water cut, pH and/or viscosity. The one or more sensors may be imaging, mapping and/or scanning devices such as, but not limited to, a camera, video, infrared, magnetic resonance, acoustic, ultra-sound, electrical, optical, impedance and capacitance. Furthermore the one or more sensors may be adapted to induce a signal or parameter detected, by the incorporation of suitable transmitters and mechanisms. The one or more sensors may sense the status of equipment within the well, for example a valve position or motor rotation.

A communication system may be installed in the well and/or the relief well. The communication system may comprise wireless communication and/or wireless signal(s). The communication system may be installed in the relief well and/or the well and may in part be provided on a probe.

When the communication system is installed in the relief well and the well, the method may include the step of communicating between the relief well and/or the well. For example, data from the one or more sensors in the well may be recovered via the well and/or the relief well. The data may be recovered before, during and/or after the relief well is created.

The data may help to determine or verify conditions in the well and on occasion be used to determine the location of a fluid leak and/or fluid path of a blow-out.

The well may further comprise an inner string defining an inner bore. The inner string is typically at least partially inside a casing string. The casing string and the inner string typically define an inner annulus therebetween. There is normally an inner fluid flow control device in the inner string to provide fluid communication between the inner annulus and the inner bore.

The inner string may overlap the second casing string. A top of the inner string typically extends above a bottom of the second casing string. The inner string may extend to surface. The overlap typically generates an annulus.

The inner string may be one or more of a drill string, test string, completion string, production string, a further casing string, and liner.

The test string may be part of a Drill Stem Test (DST). The drill string or test string or completion string is typically innermost in the well. The method may include the step of directing the fluid into the inner string.

It may be an advantage of the present invention that the fluid in the inner string kills or at least helps to kill the well. That is the fluid stops or helps to stop the flow of hydrocarbons from the geological structure and/or a reservoir, through the well and out at surface.

The well may have one or more of a perforating device, pyrotechnic device, explosive device, puncture device, rupture mechanism and valve in the first casing string, typically a wall of the first casing string and/or a sub of the first casing string, to provide fluid communication between the relief well and the first inter-casing annulus. The method may include the step of drilling through the wall of the first casing string to provide fluid communication between the relief well and the first inter-casing annulus. The one or more of the perforating device, pyrotechnic device, explosive device, puncture device, rupture mechanism and valve in the first casing string is typically in an un-cemented section, normally externally un-cemented section. There may be cement and/or a packer above and/or below the un-cemented section.

The one or more of a perforating device, pyrotechnic device, explosive device, puncture device, rupture mechanism and valve in the first casing string may be referred to as an outer fluid flow control device.

A bottom of any inter-casing annulus may be open or more typically may be closed for example by a packer or cement barrier. References herein to cement include cement substitute. A solidifying cement substitute may include epoxies and resins, or a non-solidifying cement substitute such as Sandaband™.

The primary and/or secondary fluid flow control device in the second and/or third casing string is typically at least 100 meters below a top of the second and/or third casing string. The primary and/or secondary fluid flow control device is normally towards the bottom of the second and/or third inter-casing annulus, which is typically within 500 meters, normally within 200 meters and may be within 100 meters of the bottom of the second and/or third inter-casing annulus.

The method may further include the step of: drilling through the first casing string, such that a fluid flow path is created between a first side of the first casing string and the first inter-casing annulus on a second side of the first casing string.

The step of creating a fluid communication path through the first casing string typically includes drilling through the first casing string, such that a fluid flow path is created between a first side of the first casing string and the first inter-casing annulus on a second side of the first casing string.

The method may further include the step of using data from the one or more sensors to check integrity of the first and/or second and/or third casing string before the step of drilling through the first casing string. The integrity of the first and/or second and/or third casing string may be checked before any fluid flow control device is opened.

Checking the integrity of the first and/or second and/or third casing string may be used to assess the suitability of the method for controlling the well. It is normally important to ensure that the first and/or second and/or third casing string is generally intact before using the method of the present invention to control the well.

Where the well has more than one inter-casing annulus, which is normal, the method may include measuring physical conditions in one inter-casing annulus of the well after, and normally also before, the fluid has been introduced into that inter-casing annulus and/or before fluid communication through the relevant casing string is allowed.

The integrity of the inter-casing annulus is typically assessed by conducting a pressure test. If a leak is detected, remedial action may be performed to inhibit the leak. Each further inter-casing annulus is normally similarly tested, progressing from outer to inner annuli. Thus, assuming each inter-casing annulus is assessed as being capable of withstanding the pressure applied to it, i.e. adequately but not necessarily absolutely sealed, this process is continued.

The fluid is typically eventually introduced into the part of the well where it is calculated and/or expected to kill the well. This may be an outer inter-casing annulus but is often the innermost part of the well, for example a casing bore, drill pipe or tubing. The fluid used to kill the well may be a different fluid than that used to test the integrity of the inter-casing annulus. For example, a heavier fluid may be used to kill the well.

The well may further comprise:

a transmitter, receiver or transceiver attached to the first and/or second casing string and/or third casing string when present;

the method further including the step of:

communicating between the transmitter, receiver or transceiver attached to the first and/or second casing string and/or third casing string when present and a transmitter, receiver or transceiver attached to a drill string being used to drill the relief well, to assist drilling a relief well towards the well.

When the well further comprises a transmitter, receiver or transceiver in the relief well, the method may further include the step of using the transmitter, receiver or transceiver in the relief well to at least partially wirelessly recover data from at least one of the well and relief well.

When the transmitter, receiver or transceiver is attached to the first and/or second casing string, and/or third casing string when present, it may be connected to the first and/or second casing string, and/or third casing string when present, and/or in a wall of the first and/or second casing string, and/or third casing string when present. There may be many suitable forms of connection.

The one or more sensors may be physically and/or wirelessly coupled to the transmitter, receiver or transceiver. Repeaters may be provided in the well and/or relief well. Data can be transmitted between the well and the relief well. The data may be live data and/or historical data.

The transmitters, receivers or transceivers may communicate with each other at least partially wirelessly and/or using a wireless signal and/or wireless communication. This may be by an acoustic signal and/or electromagnetic signal and/or pressure pulse and/or inductively coupled tubular. The wireless signal may be an acoustic and/or electromagnetic signal. The wireless signal may be referred to as wireless communication.

The method may further include the step of transmitting a signal through the relief well to open one or more of the outer, inner, primary and secondary fluid flow control device and direct the fluid from one or more of the relief well into the first inter-casing annulus, from the first inter-casing annulus into the second casing bore and from the second inter-casing annulus into the third casing bore. The method may further include the step of transmitting a wireless signal through the well to open the primary fluid flow control device and direct the fluid between the first inter-casing annulus and the second casing bore.

Thus the primary or other fluid flow control devices are normally wirelessly controllable. The inventors of the present invention recognise that the wireless control of the flow control device such as a valve allows the valve and/or the valve member of such embodiments to be movable between the different positions against the local pressure conditions in the well. This provides an advantage over check valves commonly used in conventional wells, wherein the corresponding movable elements move in response to the change in the local pressure conditions. Thus, unlike the wirelessly controllable valve of embodiments of the present invention, conventionally used check valves may not be moved against the local pressure conditions in the well. For certain embodiments, such a wirelessly controllable valve may be provided in addition to a check valve. The wireless control may especially be pressure pulsing, acoustic or electromagnetic control; more especially acoustic or electromagnetic control.

Indeed, it is considered that the skilled person may be deterred from adding a valve to a casing as potential leak path. However the use of a controllable valve for such embodiments ensures pressure integrity of the casing.

At least one valve may include a metal to metal seal. Accordingly the valve member and a valve seat may be made from metal, such as a nickel alloy.

The well may further comprise:

a transmitter, receiver or transceiver in the relief well;

and the method further including the step of:

using the transmitter, receiver or transceiver in the relief well to recover data from the well.

The method may further include the step of:

transmitting a wireless signal through the well and/or the relief well to open and/or close one or more of the outer, inner, primary and secondary fluid flow control device.

The method may further include the step of transmitting a wireless signal through the relief well and well to open the primary fluid flow control device and direct the fluid between the first inter-casing annulus and the second casing bore.

The method may further including the step of transmitting using wireless communication, an instruction through the well and/or relief well to close the primary fluid flow control device and restrict fluid flow between the first inter-casing annulus and the second casing bore.

The wireless signal may be transmitted in at least one or more of the following forms: electromagnetic, acoustic, inductively coupled tubulars and coded pressure pulsing. References herein to "wireless" relate to said forms, unless where stated otherwise.

Pressure pulses are a way of communicating from/to within the well/borehole, from/to at least one of a further location within the well/borehole, and the surface of the well/borehole, using positive and/or negative pressure changes, and/or flow rate changes of a fluid in a tubular and/or annulus.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used such as a pressure change or rate of pressure change, on/off keyed (OOK), pulse position modulation (PPM), pulse width modulation (PWM), frequency shift keying (FSK), pressure shift keying (PSK), and amplitude shift keying (ASK). Combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Preferably the wireless signals are such that they are capable of passing through a barrier, such as a plug, when fixed in place. Preferably therefore the wireless signals are transmitted in at least one of the following forms: electromagnetic (EM), acoustic, and inductively coupled tubulars.

The signals may be data or control signals which need not be in the same wireless form. Accordingly, the options set out herein for different types of wireless signals are independently applicable to data and control signals. The control signals can control downhole devices, including the sensors. Data from the sensors may be transmitted in response to a control signal. Moreover, data acquisition and/or transmission parameters, such as acquisition and/or transmission rate or resolution, may be varied using suitable control signals.

EM/acoustic and coded pressure pulsing use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred—they can transmit through/past an annular sealing device or barrier or annular barrier without special inductively coupled tubulars infrastructure, and for data transmission, the amount of information that can be transmitted is normally higher compared to coded pressure pulsing, especially data from the well.

The transmitter, receiver and/or transceiver used corresponds with the type of wireless signals used. For example an acoustic transmitter and receiver and/or transceiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed from tubulars such as tubing, drill pipe, or casing. At each connection between adjacent lengths there is an inductive coupling. The inductively coupled tubulars that may be used can be provided by NOV under the brand Intellipipe®.

Thus, the EM/acoustic or pressure wireless signals can be conveyed a relatively long distance as wireless signals, sent for at least 200 meters, optionally more than 400 meters or longer which is a clear benefit over other shorter range signals. Embodiments including inductively coupled tubulars provide this advantage/effect by the combination of the integral wire and the inductive couplings. The distance traveled may be much longer, depending on the length of the well.

Data and/or commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 meters, and then transmitted via acoustic or EM communications for a smaller distance, such as 200 meters. In another embodiment they are transmitted for 500 meters using coded pressure pulsing and then 1000 meters using a hydraulic line.

Thus whilst non-wireless means may be used to transmit the signal in addition to the wireless means, preferred configurations preferentially use wireless communication. Thus, whilst the distance traveled by the signal is dependent on the depth of the well, often the wireless signal, including relays but not including any non-wireless transmission, travel for more than 1000 meters or more than 2000 meters. Preferred embodiments also have signals transferred by wireless signals (including relays but not including non-wireless means) at least half the distance from the surface of the well to apparatus in the well including fluid flow control device(s) and one or more sensors.

Different wireless and/or wired signals may be used in the same well and/or relief well for communications going from the well towards the surface, and for communications going from the surface into the well.

Thus, the wireless signal may be sent directly or indirectly, for example making use of in-well relays above and/or below any sealing device or annular sealing device. The wireless signal may be sent from the surface or from a wireline/coiled tubing (or tractor) run probe at any point in the well. For certain embodiments, the probe may be positioned relatively close to any annular sealing device for example less than 30 meters therefrom, or less than 15 meters.

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be unidirectional or bi-directional. Piezoelectric, moving coil transducer or magnetostrictive transducers may be used to send and/or receive the signal.

Electromagnetic (EM) (sometimes referred to as Quasi-Static (QS)) wireless communication is normally in the frequency bands of: (selected based on propagation characteristics)

sub-ELF (extremely low frequency)<3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 meters). For more local communications, for example less than 10 meters, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

A relay comprises a transceiver (or receiver) which can receive a signal, and an amplifier which amplifies the signal for the transceiver (or a transmitter) to transmit it onwards.

The well typically includes multiple components, including the fluid flow control device(s) and one or more sensors and/or wireless communication devices. Any of the components of the well may be referred to as well apparatus.

There may be at least one relay. The at least one relay (and the transceivers or transmitters associated with the well or at the surface) may be operable to transmit a signal for at least 200 meters through the well. One or more relays may be configured to transmit for over 300 meters, or over 400 meters.

For acoustic communication there may be more than five, or more than ten relays, depending on the depth of the well and the position of well apparatus.

Generally, less relays are required for EM communications. For example, there may be only a single relay. Optionally therefore, an EM relay (and the transceivers or transmitters associated with the well or at the surface) may be configured to transmit for over 500 meters, or over 1000 meters.

The transmission may be more inhibited in some areas of the well, for example when transmitting across a packer. In this case, the relayed signal may travel a shorter distance. However, where a plurality of acoustic relays are provided, preferably at least three are operable to transmit a signal for at least 200 meters through the well.

For inductively coupled tubulars, a relay may also be provided, for example every 300-500 meters in the well.

The relays may keep at least a proportion of the data for later retrieval in a suitable memory means.

Taking these factors into account, and also the nature of the well, the relays can therefore be spaced apart accordingly in the well.

The control signals may cause, in effect, immediate activation, or may be configured to activate the well apparatus after a time delay, and/or if other conditions are present such as a particular pressure change.

The well apparatus may comprise at least one battery optionally a rechargeable battery. Each device/element of the well apparatus may have its own battery, optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The battery and optionally elements of control electronics may be replaceable without removing tubulars. They may be replaced by, for example, using wireline or coiled tubing. The battery may be situated in a side pocket.

The battery typically powers components of the well apparatus, for example a multi-purpose controller, a monitoring mechanism and a transceiver. Often a separate battery is provided for each powered component. In alternative embodiments, downhole power generation may be used, for example, by thermoelectric generation.

The well apparatus may comprise a microprocessor. Electronics in the well apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components. The electronics may be configured to be controllable by a control signal up to more than 24 hours after being run into the well, optionally more than 7 days, more than 1 month, or more than 1 year or up to 5 years. It can be configured to remain dormant before and/or after being activated.

Reference to the well and with respect to the wireless communication signals and batteries is intended to cover the well and the relief well according to the present invention.

It may not be possible to collect downhole data at a surface location, on for example a rig or platform, associated with a blown-out well. A transponder or transponders may therefore be deployed into the sea from a vessel nearby and signals sent to the transponder(s) on or adjacent to a subsea structure of the blown-out well. If for any reason these are damaged or have been destroyed in the blow-out, additional transponders can be retrofitted at any time.

By retrieving data, the condition of the well may be evaluated and an operator may be able to safely design and/or adapt the method of controlling the well. In addition, density and/or volume of the fluid required to control/kill the well may be more accurately calculated.

When the well further comprises a plurality of annuli between a plurality of casing strings and a plurality of fluid flow control devices to provide fluid communication between the plurality of annuli, a fluid flow control device in an outer casing string may be opened and then closed again before a fluid flow control device in an inner casing string or inner string is opened, but the fluid flow control devices may be opened simultaneously to allow the flow of fluid between annuli, casing bores and/or a production tubing or other inner string.

The first casing string may not be the outermost casing string. The casing string(s) may be referred to and/or comprise a liner(s). The casing string(s) may not extend to the top of the well and/or the surface. There may be a further casing string(s) of a larger diameter and therefore typically outside the first casing string.

The second casing string may be as long as the first casing string. The second casing string may extend through and/or up the well as far as the first casing string. The first and/or second casing string may extend to the top of the well and/or the surface.

The outer, inner, primary and/or secondary fluid flow control device is typically a valve. The valve is typically a check valve. There may be more than one outer, inner, primary and/or secondary fluid flow control device on the respective string.

When the outer, inner, primary and/or secondary fluid flow control device is a valve, the valve may have a valve member. The valve and/or valve member is typically moveable from a first closed position to a second open position. Optionally the valve and/or valve member can move to a further closed position or back to the first closed position. The valve may comprise more than one valve member.

The valve and/or valve member may be moveable to a check position, that may be a position between a closed position and an open position. The valve may only allow fluid flow in one direction, that is normally one or more of into the first casing annulus; from the first inter-casing annulus into the second casing bore; and/or from the second inter-casing annulus into the third casing bore. The valve may resist fluid flow in one direction, that is normally one or more of out of the first casing annulus; from the second casing bore into the first inter-casing annulus; and/or from the third casing bore into the second inter-casing annulus. The valve may allow fluid flow in both directions.

The primary, secondary, inner and/or outer fluid flow control device may comprise a valve, casing valve or rupture mechanism. The rupture mechanisms referred to above and below may comprise one or more of a rupture disk, pressure activated piston and a pyrotechnic device. The pressure activated piston may be retainable by a shear pin.

The rupture mechanism may be designed to preferentially rupture in response to fluid pressure from one side, typically an outer side. For the primary fluid flow control device the rupture mechanism may only rupture in response to fluid pressure in the first inter-casing annulus. For the secondary fluid flow control device the rupture mechanism may only rupture in response to fluid pressure in the second inter-casing annulus. For the outer fluid flow control device the rupture mechanism may only rupture in response to fluid pressure outside the first casing string.

The well may further comprise:

a rupture mechanism in the first casing string;

and the method further including the step of:

pressurising fluid on an outside of the first casing string, the pressurised fluid causing the rupture mechanism in the first casing string to rupture, thereby initiating fluid flow into the first inter-casing annulus.

When the primary, secondary, inner and/or outer fluid flow control device is in an open position, it typically has a cross-sectional fluid flow area of at least 100 $mm^2$, normally at least 200 $mm^2$, and may be 400 $mm^2$.

The primary, secondary, inner and/or outer fluid flow control device may comprise a plurality of apertures. When the primary, secondary, inner and/or outer fluid flow control device comprises a plurality of apertures, the plurality of apertures typically have a total cross-sectional fluid flow area of at least 100 $mm^2$, normally at least 200 $mm^2$, and may be 400 $mm^2$.

At least one of the primary, secondary, inner and/or outer fluid flow control devices, and/or one or more of the sensors, is normally electrically powered typically by a downhole power source. At least one of the primary, secondary, inner and/or outer fluid flow control devices, and/or one or more of the sensors, may be battery powered.

The steps of the method may be in any order. Typically the fluid is introduced before the primary, secondary, inner and/or outer fluid flow control device is opened.

The well may be an onshore well or an offshore and/or subsea well. The well is often an at least partially vertical well. Nevertheless, it can be a deviated or horizontal well. References such as "above" and "below" when applied to deviated or horizontal wells should be construed as their equivalent in wells with some vertical orientation. For example, "above" is closer to the surface of the well.

The well described herein is typically a naturally flowing well, that is fluid naturally flows up the well to surface, and/or fluid flows to the surface unassisted or unaided. The method of controlling a well in a geological structure is typically a method of controlling a naturally flowing well.

The method of controlling a well in a geological structure typically includes permanently or temporarily one or more of limiting, restricting, mitigating and preventing the flow of fluid from the well.

The method of controlling a well in a geological structure typically results in the well being returned to a safe operating condition or being put into a state in which the well can be safely suspended or abandoned.

An embodiment of the present invention will now be described, by way of example only, with reference to the accompanying drawing, in which FIG. 1 is a cross-sectional view of the well and a relief well.

FIG. 1 shows the well 10 and a relief well 40 in fluid communication with the well 10. The relief well 40 has been cemented 36 and lined with a liner 30. There is a packer 32 between the liner 30 and an inner string 38.

The well 10 comprises a first casing string 12*a* and a second casing string 12*b*, the second casing string 12*b* at least partially inside the first casing string 12*a*. The first casing string 12*a* and the second casing string 12*b* define a first inter-casing annulus 14*a* therebetween, the second casing string 12*b* defining a second casing bore 14*b* therewithin. A primary fluid flow control device 16*a* in the second casing string 12*b* provides fluid communication between the first inter-casing annulus 14*a* and the second casing bore 14*b*.

A method of controlling the well 10 in a geological structure 111 includes drilling a borehole through at least a portion of the geological structure to reach the well, thus creating the relief well 40. It also includes creating a fluid communication path through the first casing string 12*a* to provide fluid communication between the relief well 40 and the first inter-casing annulus 14*a* of the well 10 and introducing a fluid into the relief well 40 and then into the first inter-casing annulus 14*a*. The primary fluid flow control device 16*a* is opened and the fluid is directed between the first inter-casing annulus 14*a* and the second casing bore 14*b*.

The relief well 40 has been drilled through at least a portion of the geological structure 111 to reach the well 10. The method of controlling a well 10 in a geological structure according to the embodiment shown in FIG. 1 includes the step of introducing a fluid (not shown) into the inner string 38 of the relief well 40 and directing the fluid from the relief well 40 into the first inter-casing annulus 14*a*.

When drilling the relief well 40 a wireless transceiver (not shown) attached to the first casing string 14*a* communicates with a wireless transceiver (not shown) attached to the drill string used to drill the relief well. These assist drilling the relief well 40 towards the well 10. A wireless transceiver 34 in the relief well 40 is used to wirelessly recover data from the well 10.

There is an outer fluid flow control device 19 in the first casing string 12*a*. The outer fluid flow control device 19 is a rupture mechanism. The method of controlling a well 10 in a geological structure 111 includes the step of pressurising fluid on an outside 22*a* of the first casing string 12*a*, the pressurised fluid causing the rupture mechanism 19 in the first casing string 12*a* to rupture, thereby initiating fluid flow into the first inter-casing annulus 14*a* on an inside 22*b* of the first casing string 12*a*. The rupture mechanism 19 is shown ruptured in FIG. 1. It was previously sealed.

Alternatively, the drill string penetrates the wall of the outermost casing string 12*a*, bringing the relief well 40 into fluid communication with a so-called "C" annulus (14*a*).

The well is initially assessed for the suitability of using a shallow relief well. This assessment can use data from a variety of different sources. Logs or other historical information gained when drilling the pre-existing well can be useful. The integrity of various annuli is assessed and their capability to withstand the required pressure for such procedures is also assessed. Data from any real time sensors from the pre-existing well would also be used.

FIG. 1 shows that rather than drilling a relief well to a position adjacent to the bottom of the well 10, as is conventional, a shallow relief well 40 is instead drilled towards the well 10 at a much shallower depth.

The well further comprises a third casing string 12*c* defining a third casing bore 14*c* therewithin. The second casing string 12*b* and the third casing string 12*c* defining a second inter-casing annulus 14*b* therebetween, also referred to as the second casing bore 14*b*. A secondary fluid flow control device 16*b* in the third casing string 12*c* provides fluid communication between the second inter-casing annulus 14*b* and the third inter-casing annulus 14*c*. The method includes the step of opening the secondary fluid flow control device 16*b* and directing the fluid between the second inter-casing annulus 14*b* and the third inter-casing annulus 14*c*.

The option exists to collect up-to-date data from the sensors 20*a*, 20*b*, 20*c* and 20*d*, and wireless transceiver 34 which provide information on the conditions in the so-called A, B and C annuli (14*c*, 14*b* and 14*a*), relief well 40, drill pipe/tubing 25 and surrounding reservoir 111. If the downhole conditions are monitored, usually via wireless data collection, the drilling mud density and volume required can be injected into the well/formation(s), avoiding the possibility of causing a subterranean blow-out by rupturing the casing string and surrounding formation(s).

Fluid, in this case a drilling mud (not shown), is introduced into the shallow relief well 40. The drilling mud is pumped through the shallow relief well 40 into the "C" annulus 14*a*, which will fill up against a casing hanger 21*a* and cement 23*a* in the annulus. The fluid pressure in the "C" annulus 14*a* is expected to increase due to the weight of the drilling mud. Once the "C" annulus 14*a* is full of drilling mud it is then confirmed the system is holding pressure by a pressure test and using the sensor 20*b* in the "C" annulus.

When the pressure of fluid in the "C" annulus 14*a* is greater than the pressure of fluid in the "B" annulus 14*b*, the valve 16*a* is opened. A wireless signal is transmitted to open the valve 16*a*. More drilling mud is pumped into the relief well 40, which enters the "C" annulus 14*a* and then the "B" annulus 14*b*.

When the pressure of fluid in the "B" annulus 14*b* is greater than the pressure of fluid in the "A" annulus 14*c*, the valve 16*b* is opened. A wireless signal is transmitted to open the valve 16*b*. More drilling mud is pumped into the relief well 40, which enters the "C" annulus 14*a* and then the "B" annulus 14*b* and then the "A" annulus 14*c*.

In this embodiment we have the option to reclose the inter-casing valves 16*a* and 16*b* to maintain the integrity of the casing strings.

The well may typically be brought under control by introducing fluid into the A annulus, that is the inner-casing bore 14*c*. An inner valve 17 may then be used to move the fluid into the bore 14*d* of the drill string 25 to further control the well.

The process is completed once the pressure/weight of the drilling mud is enough to overcome any blow-out pressure. The continued pumping of drilling mud allows the well to be controlled and "killed" and normal re-entry/abandonment processes to then be performed. The well 10 can later be cemented in and abandoned.

In an alternative embodiment the well is brought back under control and drilling or production then recommenced. Drilling a conventional relief well to the bottom of the well damages the well structure and the well is irrevocably damaged. Unlike the present invention this means drilling or production cannot be recommenced.

Thus, such embodiments of the present invention provide a feedback system which allow better management of a hazardous control and/or kill procedure, because it is based on sensor readings rather than estimates of for example the well pressure. Moreover, monitoring can continue as the well is being controlled and/or killed, so that the control/kill procedure is adjusted and optimised according to the information being received.

It may be an advantage of the present invention that the method of controlling a well is significantly quicker. The saving may be several days, weeks or even months, reducing the potential damage to the surrounding environment as well as saving a very significant amount of time and money.

Devices such as fluid control devices and sensors associated with strings, such as casing strings, tubing strings, production strings, drilling strings, may be associated with a sub-component of the string such as tubular joints, subs, carriers, packers, cross-overs, clamps, pup joints, collars, etc.

Improvements and modifications may be incorporated herein without departing from the scope of the invention.

What is claimed is:

1. A method of controlling a well in a geological structure, the well comprising:

a first casing string and a second casing string, the second casing string at least partially inside the first casing string;

a first inter-casing annulus defined by a space between the first casing string and the second casing string a second casing bore defined by a space within the second casing string; and a primary fluid flow control device in the second casing string configured to provide fluid communication between the first inter-casing annulus and the second casing bore;

the method comprising the steps of:

drilling a borehole through at least a portion of the geological structure to reach the well, thereby to create a relief well;

creating a fluid communication path through the first casing string to provide fluid communication between the relief well and the first inter-casing annulus of the well;

introducing a fluid into the relief well and then into the first inter-casing annulus;

opening the primary fluid flow control device; and directing the fluid between the first inter-casing annulus and the second casing bore, wherein the relief well contacts the first casing string at a depth of less than 2000 meters from the surface of the geological structure.

2. A method as claimed in claim 1, the method further including the step of:

transmitting a wireless signal through the well to the primary fluid flow control device, thereby to cause the primary fluid control to open and direct the fluid between the first inter-casing annulus and the second casing bore.

3. A method as claimed in claim 2, wherein the wireless communication is by means of at least one of an acoustic signal and electromagnetic signal.

4. A method as claimed in claim 1, wherein the primary fluid flow control device comprises a valve.

5. A method as claimed in claim 4, wherein the valve comprises a check valve.

6. A method as claimed in claim 1, wherein the primary fluid flow control device comprises a rupture mechanism.

7. A method as claimed in claim 1, wherein at least one of the primary and secondary fluid flow control devices includes a metal to metal seal.

8. A method as claimed in claim 1, the method further including the step of:

measuring at least one of pressure and density of the fluid in at least one of the first inter-casing annulus and second casing bore.

9. A method as claimed in claim 1, the method further including the step of:

measuring at least one of the pressure and density of the fluid in at least one of the first inter-casing annulus and second casing bore before opening the primary fluid flow control device to direct the fluid from the first inter-casing annulus into the second casing bore.

10. A method as claimed in claim 9, wherein the step of measuring at least one of the pressure and density includes transmitting pressure and/or density data to surface using wireless communication at least partially through the well.

11. A method as claimed in claim 10, wherein the wireless communication is by means of at least one of acoustic signals, electromagnetic signals and pressure pulses.

12. A method as claimed in claim 1, the well further comprising:

a third casing string;

a third casing bore defined by a space within the third casing string, a second inter-casing annulus defined by a space between the second casing string and the third casing string; and a secondary fluid flow control device in the third casing string to provide fluid communication between the second inter-casing annulus and the third casing bore;

the method further comprising:

opening the secondary fluid flow control device to direct the fluid between the second inter-casing annulus and the third casing bore.

13. A method as claimed in claim 12, wherein the third casing string is a liner.

14. A method as claimed in claim 12, the method further including the step of:

measuring pressure and density of the fluid in at least one of the second inter-casing annulus and third casing bore before opening the secondary fluid flow control device to direct the fluid from the second inter-casing annulus into the third casing bore.

15. A method as claimed in claim 14, wherein the step of measuring at least one of the pressure and density of the fluid includes transmitting pressure and/or density data to surface using wireless communication at least partially through the well.

16. A method as claimed in claim 15, wherein the wireless communication is by means of at least one of acoustic signals, electromagnetic signals and pressure pulses.

17. A method as claimed in claim 1, wherein the step of creating a fluid communication path through the first casing string includes drilling through the first casing string, such that a fluid flow path is created between a first side of the first casing string and the first inter-casing annulus on a second side of the first casing string.

18. A method as claimed in claim 1, the well further comprising:

one or more sensors at one or more of a face of the geological structure, in the well, in an annulus, in a casing bore, in a production tubing, in any inner string;

the method further including the step of:

using data from the one or more sensors to optimise properties of the fluid that is directed between an annulus and a casing bore.

19. A method as claimed in claim 1, the well further comprising:

a transmitter, receiver or transceiver attached to at least one of the first and second casing string;

the method further comprising:

communicating between the transmitter, receiver or transceiver attached to at least one of the first and second casing string and a transmitter, receiver or transceiver attached to a drill string being used to drill the relief well, to assist drilling the relief well towards the well.

20. A method as claimed in claim 1, the well further comprising:

a transmitter, receiver or transceiver in the relief well; and the method further including the step of:

using the transmitter, receiver or transceiver in the relief well to at least partially wirelessly recover data from at least one of the well and relief well.

21. A method as claimed in claim 1, the well further comprising:

one or more sensors at one or more of a face of the geological structure, in the well, in an annulus, in a casing bore, in a production tubing, in any inner string;

the method further including the step of:

using data from the one or more sensors to optimise properties of the fluid that is directed between an annulus and a casing bore; and wherein the data from the one or more sensors is transmitted wirelessly.

22. A method as claimed in claim 1, the method further including the step of:

transmitting using wireless communication, an instruction through the well to close the primary fluid flow control device and restrict fluid flow between the first inter-casing annulus and the second casing bore.

23. A method as claimed in claim 1, wherein the relief well only penetrates the first casing string.

24. A method of controlling a well in a geological structure, the well comprising:

a first casing string and a second casing string, the second casing string at least partially inside the first casing string;

a first inter-casing annulus defined by a space between the first casing string and the second casing string;

a second casing bore defined by a space within the second casing string; and a primary fluid flow control device in the second casing string to provide fluid communication between the first inter-casing annulus and the second casing bore;

the method comprising the steps of:

drilling a borehole through at least a portion of the geological structure to reach the well, thereby to create a relief well;

creating a fluid communication path through the first casing string to provide fluid communication between the relief well and the first inter-casing annulus of the well;

introducing a fluid into the relief well and then into the first inter-casing annulus; and opening the primary fluid flow control device by transmitting a wireless signal through the relief well to direct the fluid between the first inter-casing annulus and the second casing bore.

25. A method of controlling a well in a geological structure, the well comprising:

a first casing string and a second casing string, the second casing string at least partially inside the first casing string;

a first inter-casing annulus defined by an area inside of the first casing string and outside of the second casing string defining, a second casing bore defined by an area inside of the second casing string; and a primary fluid flow control device in the second casing string to provide fluid communication between the first inter-casing annulus and the second casing bore;

one or more sensors at one or more of a face of the geological structure, in the well, in an annulus, in a casing bore, in a production tubing, and in any inner string;

the method comprising the steps of:

drilling a borehole through at least a portion of the geological structure to reach the well, thereby to create a relief well;

creating a fluid communication path through the first casing string to provide fluid communication between the relief well and the first inter-casing annulus of the well;

introducing a fluid into the relief well and then into the first inter-casing annulus;

opening the primary fluid flow control device to direct the fluid between the first inter-casing annulus and the second casing bore; and using data from the one or more sensors to optimise properties of the fluid that is directed between an annulus and a casing bore.

* * * * *